US006880827B2

(12) United States Patent
Stefan

(10) Patent No.: US 6,880,827 B2
(45) Date of Patent: Apr. 19, 2005

(54) DOUBLE DEAL

(76) Inventor: Alexander Stefan, 3100 Sirius Ave., Las Vegas, NV (US) 89102-0421

( * ) Notice: Subject to any disclaimer, the term of this patent is extended or adjusted under 35 U.S.C. 154(b) by 158 days.

(21) Appl. No.: 10/064,368

(22) Filed: Jul. 7, 2002

(65) Prior Publication Data

US 2004/0004324 A1 Jan. 8, 2004

(51) Int. Cl.[7] ..... A63F 1/00
(52) U.S. Cl. ..... 273/292; 463/13
(58) Field of Search ..... 273/292, 138.1, 273/139; 463/12, 13

(56) References Cited

U.S. PATENT DOCUMENTS

| | | | | |
|---|---|---|---|---|
| 5,356,140 A | * | 10/1994 | Dabrowski et al. | 463/12 |
| 5,437,451 A | | 8/1995 | Fulton | 273/138 |
| 5,531,440 A | * | 7/1996 | Dabrowski et al. | 463/12 |
| 5,531,441 A | * | 7/1996 | Dabrowski et al. | 463/12 |
| 5,785,593 A | | 7/1998 | Wood et al. | 463/13 |
| 5,816,915 A | | 10/1998 | Kadlic | 463/13 |
| 6,045,129 A | | 4/2000 | Cooper et al. | 273/292 |
| 6,050,568 A | | 4/2000 | Hachquet | 273/292 |
| 6,135,882 A | | 10/2000 | Kadlic | 463/13 |
| 6,146,271 A | | 11/2000 | Kadlic | 463/13 |
| 6,332,614 B1 | * | 12/2001 | Hesse | 273/292 |
| 6,416,407 B1 | * | 7/2002 | Carrico et al. | 463/13 |
| 2002/0132657 A1 | * | 9/2002 | Matthiesen et al. | 463/13 |

* cited by examiner

*Primary Examiner*—Derris H. Banks
*Assistant Examiner*—Alex F. R. P. Rada, II
(74) *Attorney, Agent, or Firm*—Robert Ryan Morishita; Morishita Law Firm, LLC

(57) ABSTRACT

After making a wager to participate in a game, a player is dealt two distinct hands at the beginning of the game, each hand being dealt from a separate deck of playing cards. The card values for only one of the hands is fully revealed to the player, and the player is required to select which of the two hands will be played in the game. The unselected hand is removed from further play. If the fully revealed hand is not selected, the value of any remaining unknown cards is revealed to the player, and play proceeds in a conventional manner. If the hand having card values not fully revealed is selected by the player, the payout table is modified by removing a previous winning result to accommodate the changed odds in the player's favor.

18 Claims, 3 Drawing Sheets

DOUBLE DEAL

BACKGROUND OF INVENTION

1. Field of the Invention

The present invention relates to a poker game and, more particularly, to a poker game in which the player has an option of choosing between a first and a second hand dealt from separate decks of cards. More specifically, the present invention relates to a poker game that permits the player to reject an initial hand for a hidden, second hand, with an adjustment to the payout table also made upon a selection of the second hand, reflecting the changed odds.

2. Description of the Prior Art

The initial popularity of video poker machines was somewhat of a surprise to the gaming industry. It was not long before their popularity eclipsed the traditional slot machine. Various explanations followed to explain this phenomenon, and in more recent times a number of variations have been introduced in an effort to keep this concept fresh.

As originally offered, video poker was based on a game of five card draw, using a single deck of cards. An original five card hand is dealt, and the player elects which, if any, will be held. The non-held cards are discarded, and, using the same single deck, replacement cards are dealt to bring the card count up to five. This five card combination defines the "final hand," and the player's winnings, if any, are determined by a comparison of this hand to a payout table. Winning card combinations are paired with possible initial wagers to calculate payoffs.

The spread of legalized gaming, particularly through Indian gaming expansion, has intensified the competition for players. In response video game manufacturers have sought to design and provide different types of electronic video poker games. Subsequent modifications have included changes to the game itself, including the use of "wild cards," such as "jokers" and "deuces," as well as adapting seven-card stud poker, and similar variations, in a video game format.

Other modifications have been to the process of playing the game. As players familiar with video games become an increasing percentage of potential customers, casinos are demanding video poker machines that offer alternatives to the player. These options might include the ability to play multiple games of video poker for a single wager, or the ability to replay a hand, such as is disclosed in Cooper et al., U.S. Pat. No. 6,045,129. A more recent innovation of play permits a player to select from two distinct hands at the beginning of a game, Dabrowski et al., U.S. Pat. No. 5,356,140. Under this latter procedure, two distinct hands are dealt face up, from separate decks, and the player selects one of them for play, with the unselected hand voided or removed from view.

Notwithstanding these newer variations on the original video poker game, there continues to be a demand for new and interesting video poker games to maintain the interest of present gamblers while attracting the uninitiated. Studies of gaming psychology have indicated that the gambling experience is heightened by providing a player with additional or alternative opportunities for reward, but with an associated and unknown risk. There is a need for a video poker game that provides such alternative opportunities for a player, increasing the likelihood of initiating play of the machine, as well as the likelihood that a player will remain playing through multiple play cycles.

It is an object of the present invention to provide a method of playing a card game, either live or electronic, that encourages extended play time by providing additional play options of unknown risk/reward.

It is a feature of the present invention to provide a method of playing a card game in which a player is provide an option of rejecting an initial hand of known card values for a second hand of unknown card values that is dealt from a separate deck. Upon selection of the second deck, the first deck is removed, the card values of the second deck become known, and an adjustment is made to the payout tables to reflect the odds benefit to the player of obtaining the second hand. The second hand is played out by the player in a conventional manner, and wins or losses are determined by the revised payout table.

It is an advantage of the present invention that more interest in the poker game is obtained by providing an optional replacement hand of unknown card values. The payback percentage is maintained by altering the payout table to accommodate the optional election of hands. The increased interest in playing combined with payout table adjustments results in increased profits to the gaming machine owner/operator.

These objects, as well as other objects and advantages of the present invention will become readily apparent upon review of the description of a non-limiting illustrative embodiment and the accompanying drawings.

SUMMARY OF INVENTION

Although appropriate for both live game and electronic gaming machines, the overwhelming popularity of gaming machine suggests the latter is the more likely platform for the present invention. Initiated in a conventional manner by the deposit a wager consisting of one or more coins, the player is dealt two separate hands from separate decks of playing cards (virtual in the case of a gaming machine). One of the hands is conventionally dealt face up, with the card values visible to the player. The second hand is dealt face down, concealing the card values. The player is presented with a choice: continue play with the first, face up hand or elect to play with the concealed, second hand.

After the choice is made, the unselected hand is removed and play of the hand proceeds in a conventional manner, with the player permitted to hold any combination of the playing cards, replacing those not held with new cards drawn from the same deck. Winning results, and the amount of money disgorged, are both determined by the payout table.

Alternatively, if the player elects to play the game with the second, concealed hand, the initial hand is removed, and the card values for the hidden hand are revealed. Play of the game then proceeds as discussed above, with certain cards held and replacement cards dealt to form the final hand. Winning results and award values are again determined by a payout table. However, to account for the change in odds associated with the ability to replace the initial hand, the payout table changes if the concealed hand is chosen. This change may typically result in the elimination of the most common of the winning events. For example, many video poker machines will award "Jacks or better" with the return of the wager placed. A changed payout table in accordance with the present invention might eliminate this as a winning result, with the "lowest" payout table winning event listed as "two pair."

DETAILED DESCRIPTION

Figure 1:
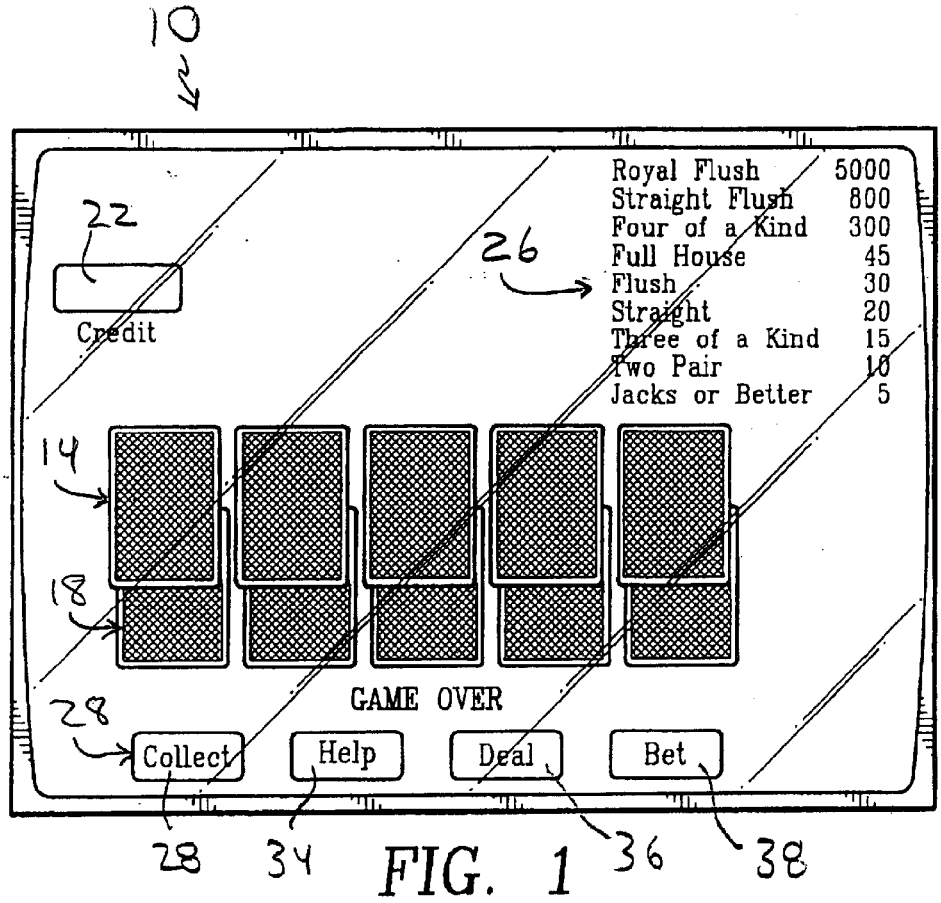
FIG. 1 shows a video screen display and payout table used in the method of the present invention prior to initiation of a game cycle.

Reference is now made to the drawings wherein like numerals refer to like parts throughout. In FIG. 1, a video display screen 10 displays a player's first hand 14 and a player's second hand 18 with no card values shown. Traditionally, display screen for video poker games continue to display the card values of the last hand until a new play cycle is initiated. To communicate the availability of the second hand 18, this screen would occur at the conclusion of a play cycle, and remain until the initiation of a new play cycle.

The video display screen 10 also communicates other information to the player, including a credit display 22 where the number of remaining credits is shown, and a payout table 26 that establishes the identity of winning card combinations and the awards associated with each such winning combination. A plurality of control buttons 28 are also provided to operate various machine functions, including a collect button 32, a help button 34, a deal button 36, and a bet button 38. It is to be understood that other control functions may also be displayed, such as "bet maximum credits," without departing from the spirit or scope of the present invention.

Figure 2:
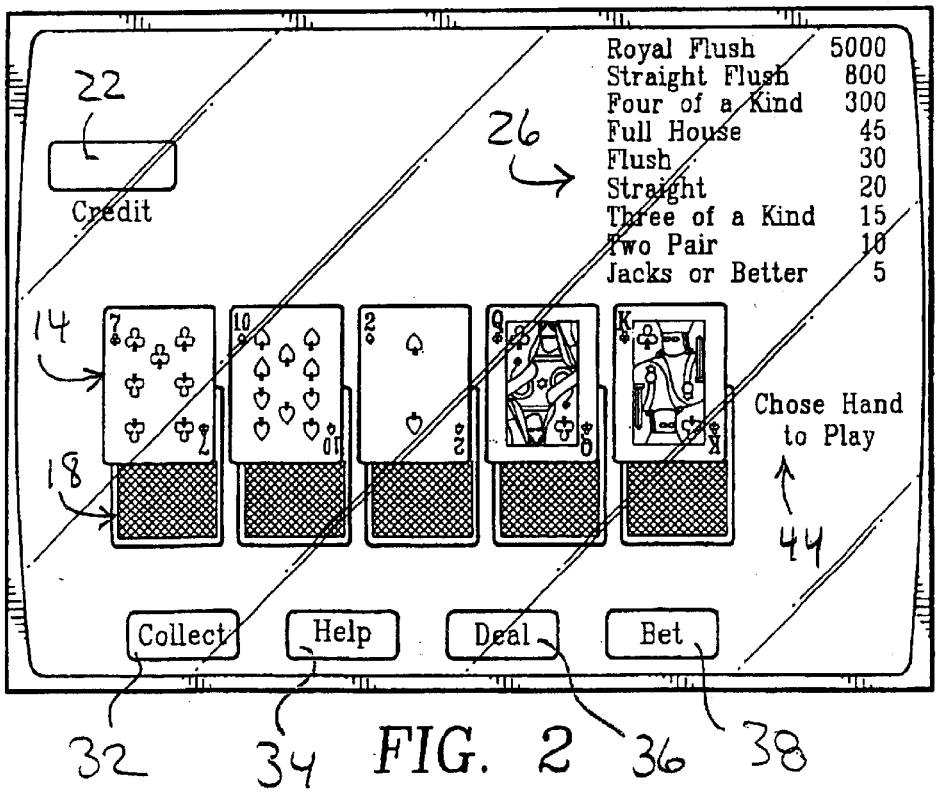
FIG. 2 shows a video screen display and payout table used in the method of the present invention after the player has initiated play of the gaming machine.

Activation of the gaming machine is attained in a conventional manner by a player placing one or more coins or gaming tokens in an acceptor (not shown in the Figures) and then pressing first the bet control button 38, to establish the bet level, and then the deal control button 36. As is shown in FIG. 2, upon such initiation, the card values for the player's first hand 14 are revealed, while the backs are shown for each of the cards of the player's second hand 18, concealing the card values. The two hands are shown in superposed relation to conserve screen space, and various other display arrangements are considered as lying within the scope of the present invention.

Figure 3:
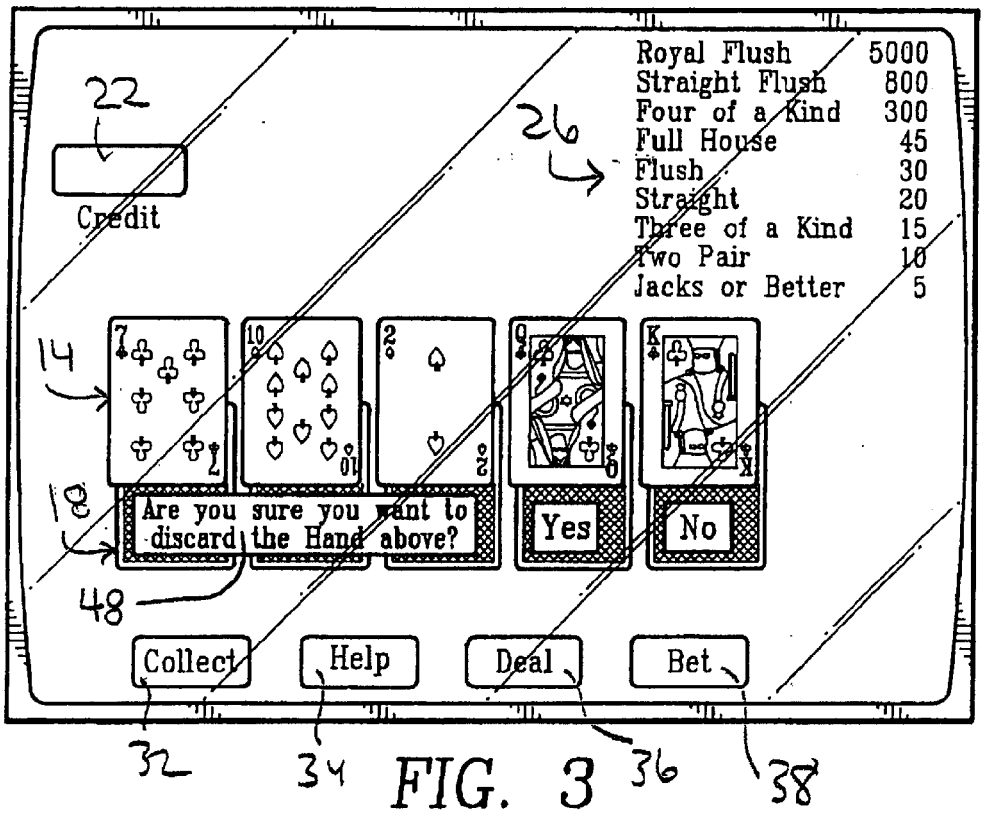
FIG. 3 shows a video screen display and payout table used in the method of the present invention after the player has identified a hand to play.

An instructional display 44 communicates a play option to a player, and in FIG. 2, the player is advised of an ability to choose between the first and second hands 14, 18. Such selection can be made using many different mechanisms, with touch screen activation preferred based upon the technology presently in use with video gaming machines. In FIG. 3, such a selection has been made, and a confirming message 48 appears on the video display screen 10 requesting the player to confirm his or her prior selection as between the first and second hands 14, 18.

FIG. 3 displays the election by a player of the first hand 14. The second hand 18 is removed from view, and a plurality of hold option buttons 52 appear, one adjacent each of the playing cards of the first hand 14. Upon activation by a player, such as by touching where a touch screen is provided, the hold button 52 is transformed into a held indicator button, communicating to a player that the associated playing card is being "held" under game rules. Thereafter, play continues in a conventional video poker manner, with all non-held cards replaced by new cards drawn from the same deck. The resulting playing card selection defines the "final hand," and this hand is compared to the winning card combinations identified by the payout table 26.

Figure 4:
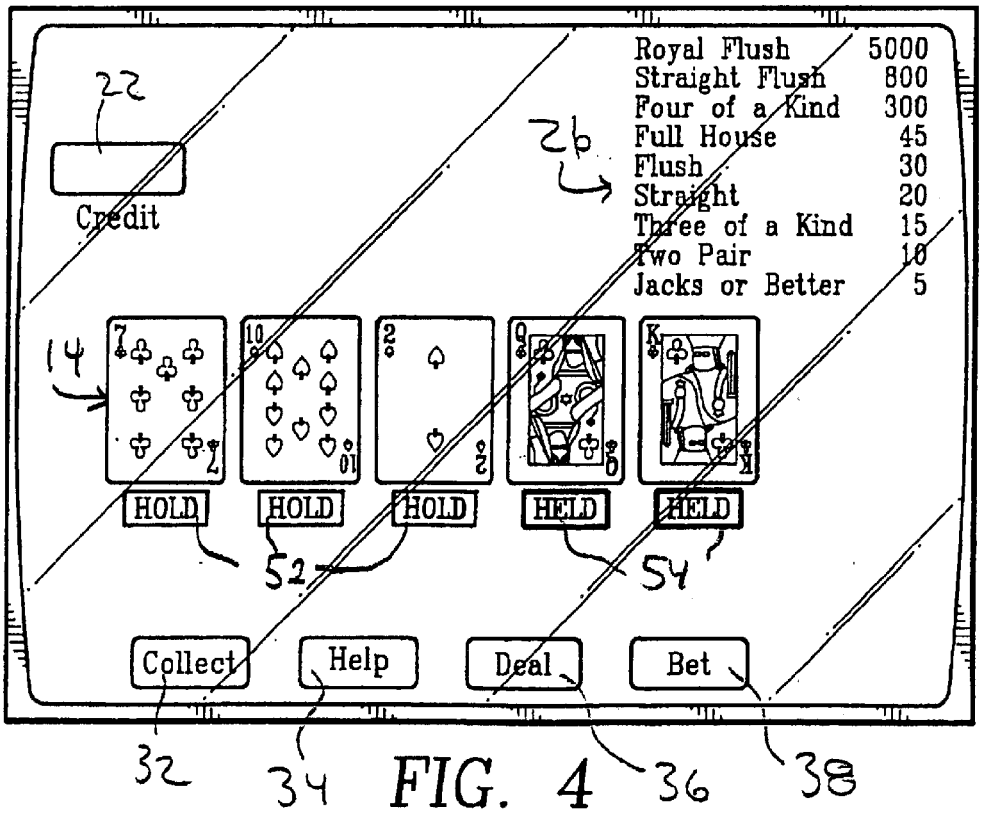
FIG. 4 shows a video screen display and payout table used in the method of the present invention after the player has elected to play the initial hand.
Figure 5:
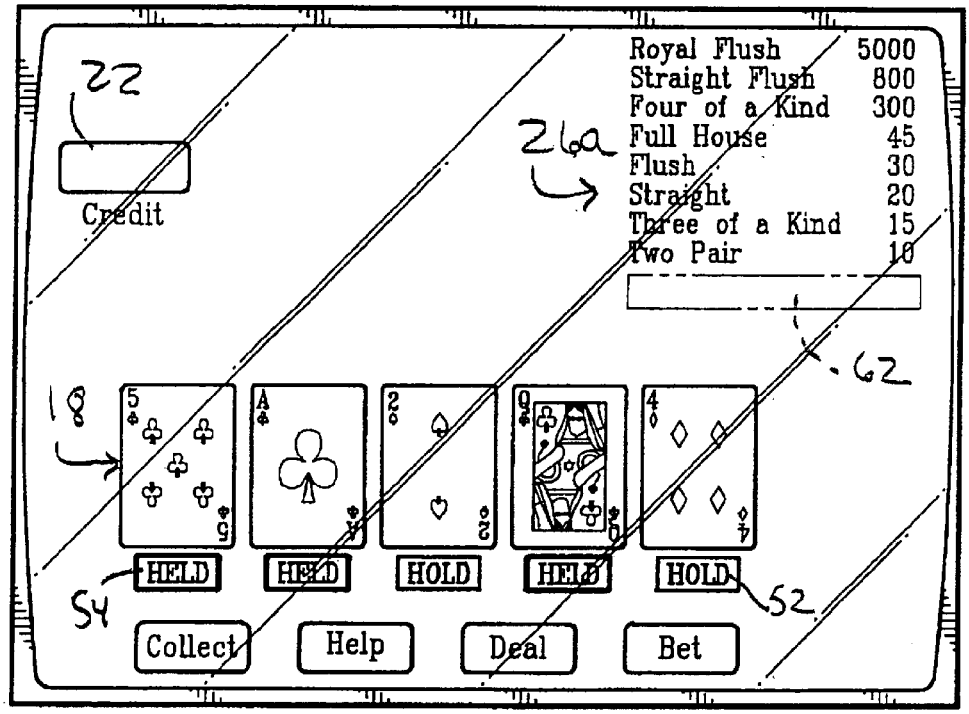
FIG. 5 shows a video screen display and payout table used in the method of the present invention after the player has elected to play the second or concealed hand.

FIG. 4 displays the election by a player of the second hand 18 a hand that until this election had concealed the individual playing card values from the player. The card values are then revealed, and play continues as was discussed in the context of FIG. 3, above. The hold option buttons 52 are activated by the player as required, with the more desirable cards held and the less desirable replaced by new cards. The final playing card combination is then compared to the winning combinations identified by a modified payout table 26*a*. Such modification by a removed winning combination 62 (shown in phantom in FIG. 5) accommodates the change of odds in the player's favor resulting from the ability of a player to make this election between the first and second hands 14, 18.

My invention has been disclosed in terms of a preferred embodiment thereof, which provides a method of playing a card game that is of great novelty and utility. Various changes, modifications, and alterations in the teachings of the present invention may be contemplated by those skilled in the art without departing from the intended spirit and scope thereof. It is intended that the present invention encompass such changes and modifications.

What is claimed is:

1. A method of playing a draw poker game comprising:

a) dealing a player a first five card hand from a first deck of playing cards;

b) dealing the player a second five card hand from a second deck of playing cards;

c) identifying to the player a playing card value for each of the playing cards of the first five card hand;

d) concealing from the player a playing card value for one or more of the playing cards of the second five card hand;

e) the player selecting either the first hand or the second hand;

f) identifying to the player a playing card value for each of the playing cards of the second five card hand not previously identified in response to the player selecting the second hand;

g) the player either standing on the hand selected or discarding one or more cards from the hand selected;

h) dealing the player replacement cards for the discarded cards, if any;

i) determining a value for the player's selected hand as modified by any of said replacement cards based on conventional poker hand ranking; and j) awarding the player a predetermined amount based on said value.

2. The method of claim 1, and further comprising the step of modifying the award to the player where the player selects the second hand.

3. The method of claim 2, wherein the player's selected hand having value under a conventional poker hand ranking is not awarded a predetermined amount where the player selects the second hand.

4. The method of claim 1 in which each deck of playing cards is a standard 52 card deck.

5. The method of claim 1 in which each deck of playing cards is a standard 52 card deck plus at least one extra Joker card which is treated as a wild card.

6. The method of claim 1 in which each deck of playing cards is a standard 52 card deck with at least one of the cards being treated as a wild card.

7. The method of claim 1 in which the value of the player's selected hand is determined by comparing the poker hand ranking of the player's selected hand to a payout schedule.

8. The method of claim 7 in which the predetermined amount based on the value of the player's selected hand is based on a payout schedule.

9. The method of claim 8, and further comprising modifying the payout schedule where the player selects the second hand.

10. The method of claim 9, in which a previously winning result provided by the payout schedule is removed.

11. A method of playing a draw poker game on an electronic gaming machine comprising:

a) electronically displaying to a player a first five card hand face up from a first deck of playing cards;

b) electronically displaying five cards face down;

c) the player selecting either the first hand or the face down cards;

d) displaying to the player a second five card hand face up after the player has selected the face down cards;

e) the player either standing on the hand selected or discarding one or more cards from the hand selected;

f) electronically determining a value for the hand selected by the player as modified by any discards based on conventional poker hand ranking; and g) awarding the player a predetermined amount based on said value.

12. The method of claim 11 in which each deck of playing cards is a standard 52 card deck.

13. The method of claim 12 in which each deck of playing cards is a standard 52 card deck plus at least one extra Joker card which is treated as a wild card.

14. The method of claim 13 in which each deck of playing card is a standard 52 card deck with at least one of the cards being treated as a wild card.

15. The method of claim 11 in which the value of the player's selected hand is determined by electronically comparing the poker hand ranking of the player's selected hand to a payout schedule.

16. The method of claim 15 in which the predetermined amount based on the value of the player's selected hand is based on a payout schedule.

17. The method of claim 11 in which the player is awarded by accruing credits on a credit meter displayed on the gaming machine.

18. A method of playing a draw poker game on an electronic gaming machine comprising:

a) a player wagering at least one coin;

b) electronically displaying to the player a first five card hand face up from a first deck of playing cards;

c) storing a signal representation of a second five card hand from a second deck of playing cards and displaying five cards face down;

d) the player selecting either the first hand or the face down cards;

e) electronically displaying to the player the second five card hand face up in response to selection of the face down cards;

e) the player either standing on the hand selected or discarding one or more cards from the hand selected;

f) electronically displaying to the player replacement cards for the discarded cards, if any;

g) electronically determining a value for the player's selected hand as modified by any replacement cards based on conventional poker hand ranking, and h) paying the player a predetermined amount of coins based on said value.

* * * * *